US007070462B2

(12) United States Patent
Conn

(10) Patent No.: US 7,070,462 B2
(45) Date of Patent: Jul. 4, 2006

(54) ELECTRICAL CONNECTOR WITH EXPANDABLE TUBULAR CLAMPING SECTIONS

(75) Inventor: Gary A Conn, Mobile, AL (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/002,521

(22) Filed: Dec. 1, 2004

(65) Prior Publication Data

US 2005/0118885 A1 Jun. 2, 2005

Related U.S. Application Data

(60) Provisional application No. 60/526,545, filed on Dec. 2, 2003.

(51) Int. Cl.
*H01R 11/01* (2006.01)
*H01R 11/09* (2006.01)

(52) U.S. Cl. ..... 439/783; 439/787

(58) Field of Classification Search ..... 439/783, 439/796, 786, 787, 788, 854, 839, 776
See application file for complete search history.

(56) References Cited

U.S. PATENT DOCUMENTS 4,136,922 A * 1/1979 Grebik ..... 439/867
4,169,652 A * 10/1979 Hockele et al. ..... 439/781
4,553,799 A * 11/1985 Deters ..... 439/507
5,477,680 A 12/1995 Heskey et al. ..... 60/452
5,507,671 A 4/1996 Chadbourne et al. ..... 439/783
5,553,478 A 9/1996 Di Troia ..... 72/453.15
6,796,854 B1 * 9/2004 Mello et al. ..... 439/796
2002/0142674 A1 * 10/2002 Chadbourne et al. ..... 439/783

* cited by examiner

*Primary Examiner*—Chandrika Prasad
(74) *Attorney, Agent, or Firm*—Harrington & Smith, LLP

(57) ABSTRACT

An electrical connector including two tube sections which are open at a first end of the connector; and a connecting section connecting the two tube sections to each other. The tube sections and the connecting section form a conductor receiving area which is open at the first end of the connector. The tube sections are adapted to be expanded towards each other to capture the conductor. An electrical connector attachment tool is provided for the connector which includes a stationary section and a movable section which can exert a compressive force to an electrical connector positioned between the movable section and the stationary section. At least one of the stationary section and movable section includes a connector wedge. The connector wedge includes two wedge shaped projections extending in a same direction and a conductor guiding channel between the two wedge shaped projections.

18 Claims, 14 Drawing Sheets

ELECTRICAL CONNECTOR WITH EXPANDABLE TUBULAR CLAMPING SECTIONS

CROSS REFERENCE TO RELATED APPLICATION

This application claims priority under 35 U.S.C. 119(e) on U.S. Provisional Patent Application No. 60/526,545 filed on Dec. 2, 2003, which is hereby incorporated by reference in its entirety.

BACKGROUND OF THE INVENTION

1. Field of the Invention

The present invention relates to electrical connectors and a tool for connecting an electrical connector to a conductor.

2. Brief Description of Prior Developments

U.S. Pat. No. 5,507,671 discloses an electrical wedge connector with a spring wedge. U.S. Pat. Nos. 5,477,680 and 5,553,478 disclose battery operated, hand-held hydraulic compression tools. FCI USA, Inc. manufactures and sells an INSULINK™ electrical connector which is an in-line connector that is crimped onto two conductors to connect the conductors to each other.

There is a desire for an in-line electrical connector which is less expensive to manufacture than conventional in-line electrical connectors.

SUMMARY OF THE INVENTION

In accordance with one aspect of the present invention, an electrical connector is provided comprising two tube sections which are open at a first end of the connector; and a connecting section connecting the two tube sections to each other. The tube sections and the connecting section form a conductor receiving area which is open at the first end of the connector. The tube sections are adapted to be expanded towards each other to capture the conductor between the two tube sections.

In accordance with another aspect of the present invention, an electrical connector attachment tool is provided comprising a stationary section; and a movable section movable relative to the stationary section to exert a compressive force to an electrical connector positioned between the movable section and the stationary section. The stationary section and/or the movable section comprises a connector wedge. The connector wedge comprises two wedge shaped projections extending in a same direction and a conductor guiding channel between the two wedge shaped projections.

In accordance with one method of the present invention, a method for connecting an electrical connector to an electrical conductor is provided comprising inserting the electrical conductor into a receiving area of the electrical connector, the receiving area being at least partially defined by spaced tube sections of the electrical connector; and expanding the tube sections generally radially towards each other to thereby at least partially clamp the electrical conductor between the tube sections.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
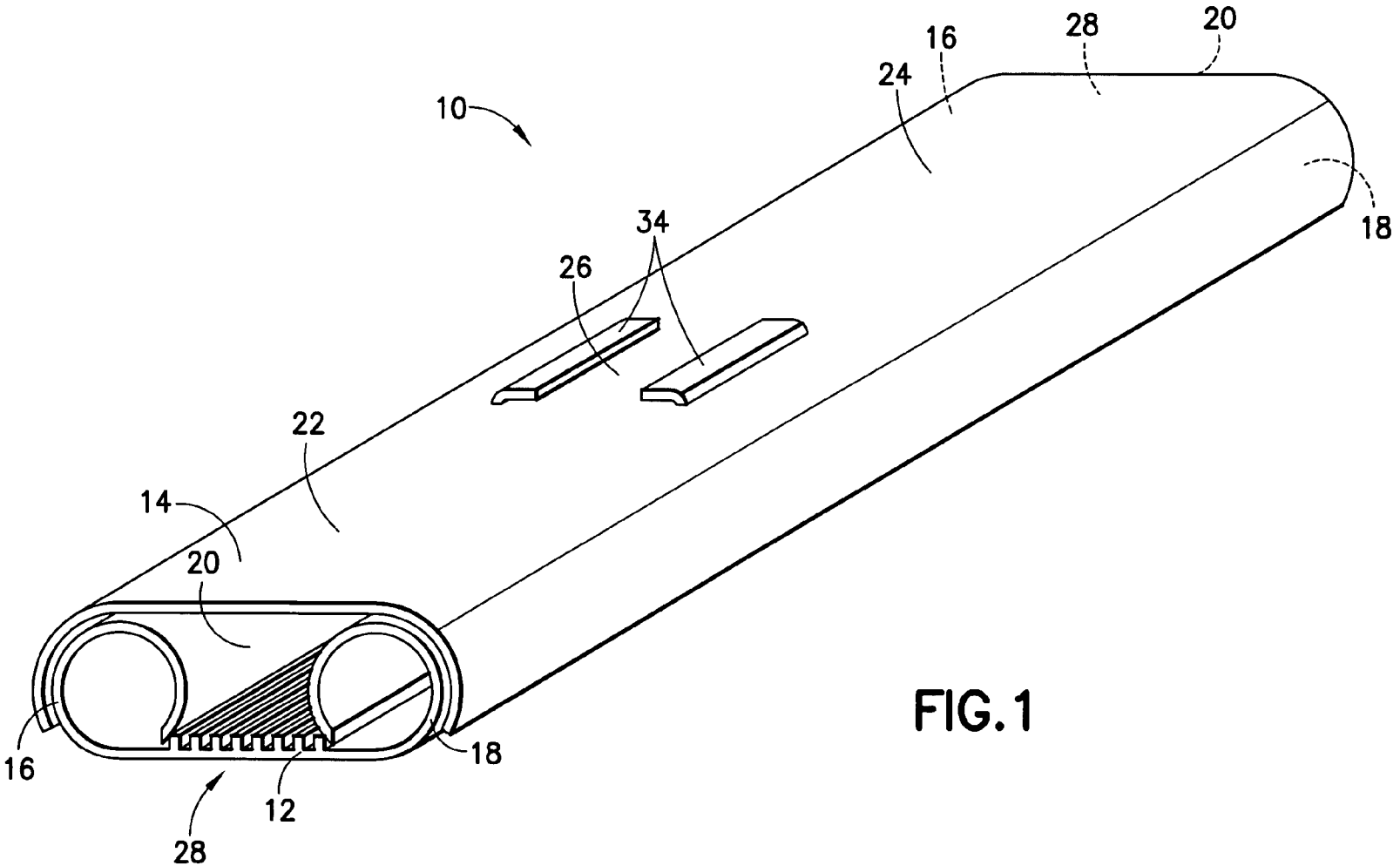
FIG. 1 is a perspective view of an electrical connector incorporating features of the present invention.

Referring to FIG. 1, there is shown a perspective view of an electrical connector 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The electrical connector 10 generally comprises a first member 12 and a second member 14. The first and second members 12, 14 are preferably comprised of metal. The electrical connector 10 generally comprises two connection sections 22, 24 and a middle section 26. Each connection section 22, 24 generally comprises two tube sections 16, 18 and a connecting section 20 which connects the two tube sections to each other. The two tube sections in each connection section are generally parallel to each other. As further described below, each connection section 22, 24 forms a conductor receiving area 28. The tube sections 16, 18 at each connection section 22, 24 are adapted to be expanded towards each other to capture a conductor between the two tube sections.

Figure 2:
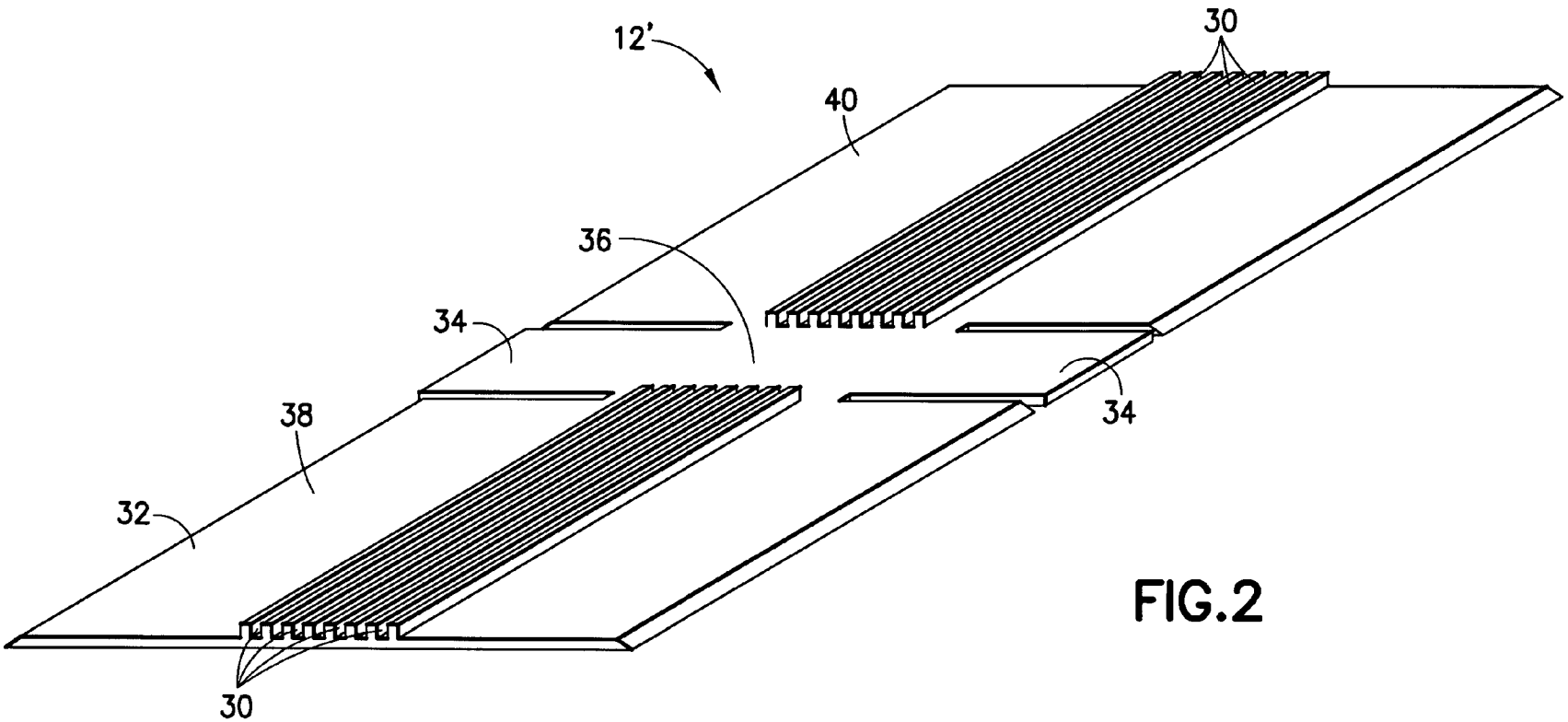
FIG. 2 is a perspective view of a blank used to form one of the members which forms the electrical connector shown in FIG. 1.
Figure 3:
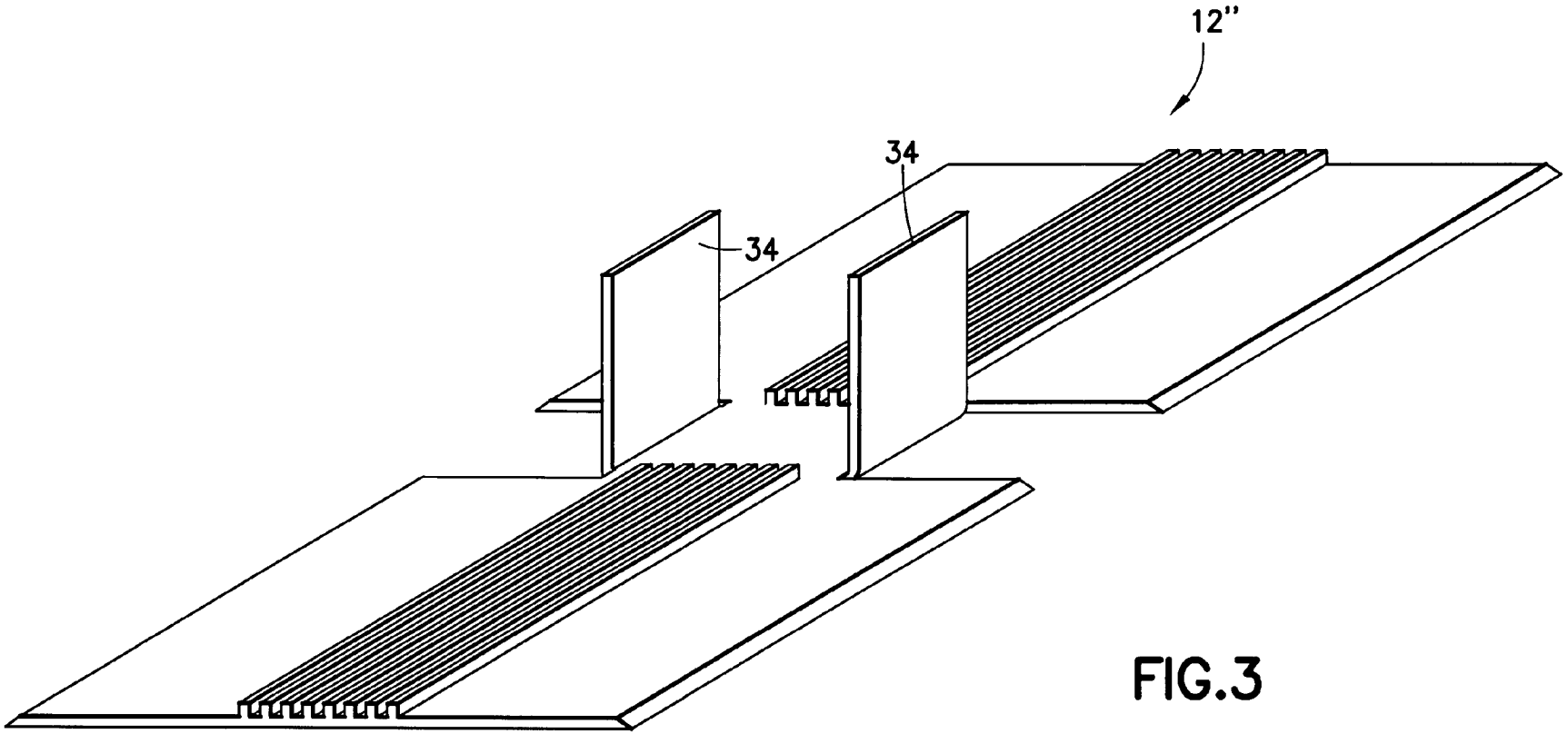
FIG. 3 is a perspective view of the blank shown in FIG. 2 with two connecting tabs being formed on the blank.
Figure 4:
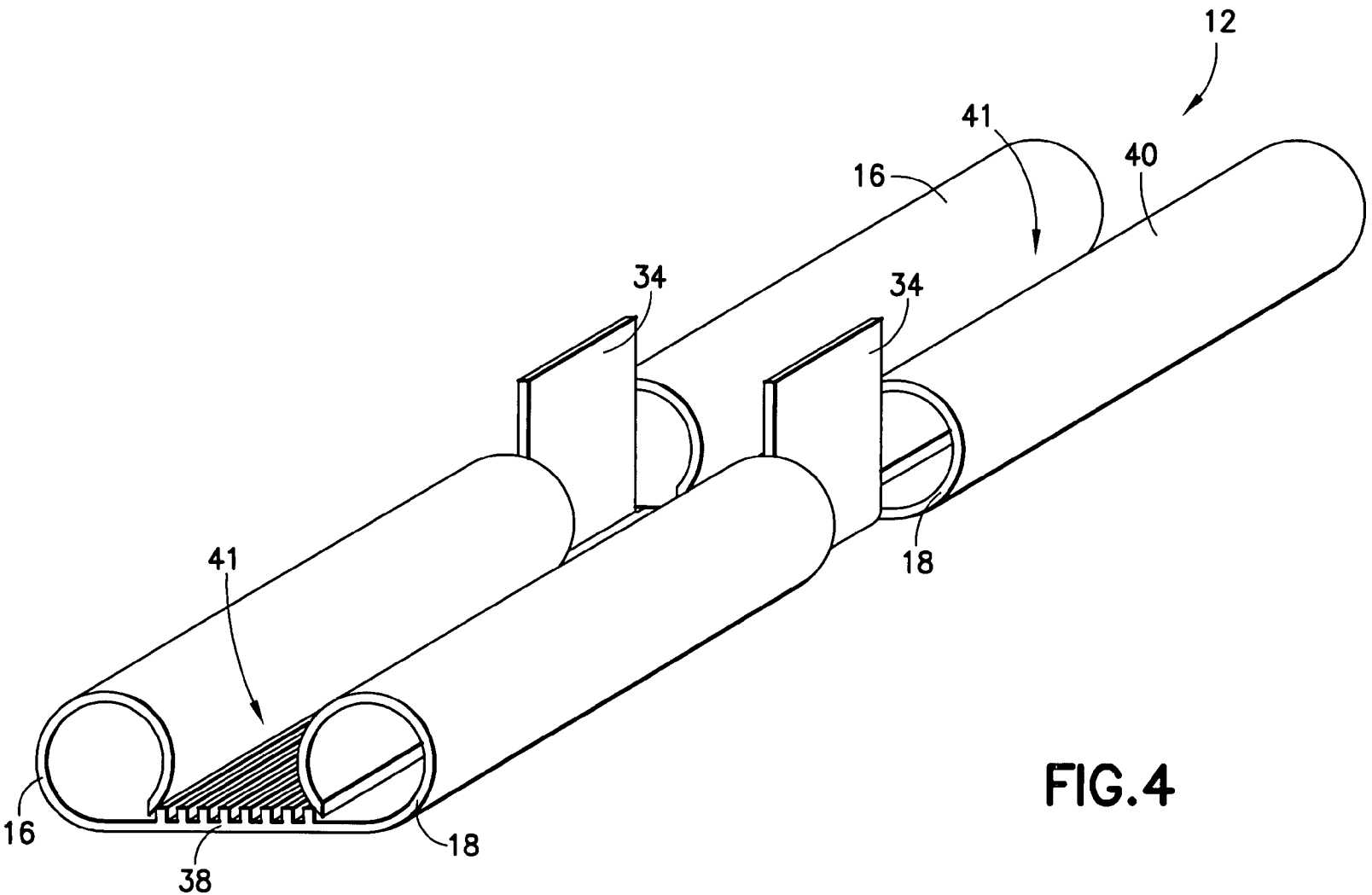
FIG. 4 is a perspective view of the blank shown in FIG. 3 which has been formed into a first member of the of electrical connector shown in FIG. 1.

Referring now also to FIGS. 2–4, the first member 12 (see FIG. 4) is preferably formed from a substantially flat blank 12' (see FIG. 2). The blank 12' is preferably comprised of an aluminum alloy extrusion. However, in alternate embodiments, the blank 12' could be comprised of sheet metal which has been stamped into the shape shown. In addition, the blank 12' could be comprised of any suitable type of electrically conductive metal. In the embodiment shown, the blank 12' has a general rectangular shape which is 2 inches by 2.75 in. in size. However, in alternate embodiments, the blank 12' could comprise any suitable type of size. Because the blank 12' is formed by an extrusion process, the blank could have any suitable type of cross sectional shape, and need not be flat.

The blank 12' is formed with a series of parallel grooves 30 on a first side 32 which form latches as further described below with respect to FIGS. 12–15. These grooves 30 can be formed during the extrusion process. The grooves 30 extend longitudinally along first and second portions 38, 40 with a center area 36 located between the first and second portions. The blank 12' also comprises two tabs 34 in the center area 36 of the blank. The two tabs 34 are preferably cut or stamped into the center area after the extrusion process.

As seen with reference to FIG. 3, after the tabs 34 are formed the tabs are then bent upwards into a general vertical position to form intermediate blank 12". As seen with reference to FIG. 4, the lateral edges of the first and second portions 38, 40 are rolled or bent lengthwise into the two tube sections 16, 18 at the first and second portions 38, 40. An open area 41 is formed between the opposing pairs of tube sections 16, 18 at each of the first and second portions 38, 40.

Figure 5:
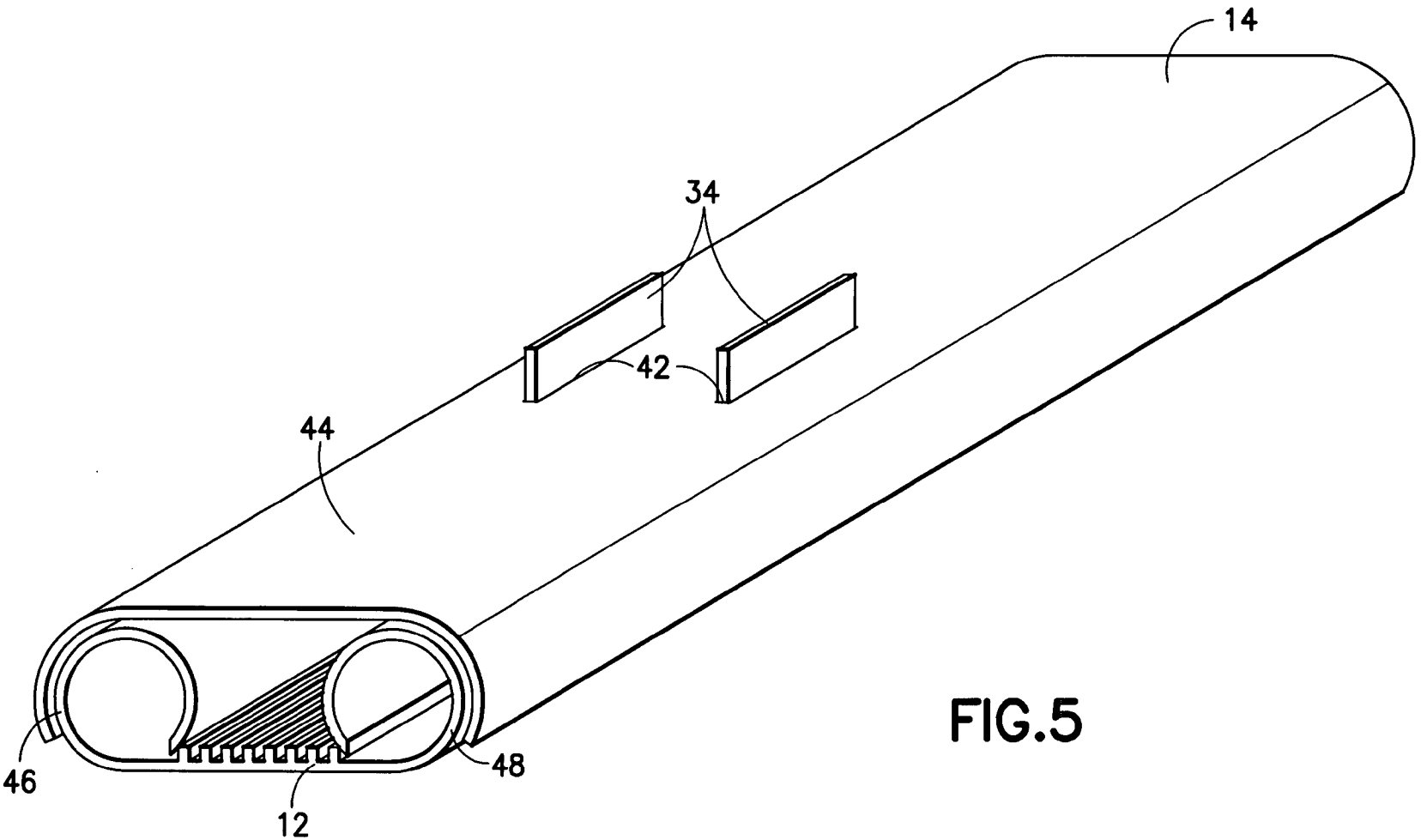
FIG. 5 is a perspective view of the first member shown in FIG. 4 with the second member initially attached thereto.

Referring now also to FIG. 5, after the first member 12 is formed the second member 14 is then placed onto the first member 12 and fixedly attached thereto. The second member 14 is preferably comprised of an extruded aluminum alloy. However, in alternate embodiments, the second member 14 could be comprised of any suitable type of electrically conductive material, or could be comprised of non-electrically conductive material. In addition, the second member 14 could be formed by any suitable type of process, such as stamped and formed sheet metal. Thus, the second member 14 does not need to be formed by an extrusion process.

The second member 14 forms an outer member of the connector and has a general upside-down longitudinal channel shape. More specifically, the second member 14 comprises a substantially flat middle section 44 and two curved sides sections 46, 48 along its length; The second member 14 generally comprises a center area with two slots 42 therethrough. The second member 14 is adapted to be placed on top of the first member 12 with the curved sides sections 46, 48 being located along the exterior sides of the tube sections 16, 18. In a preferred embodiment, the second member 14 snaps onto the first member 12. A portion of the outer member 14 forms a side of the conductor receiving area. When the second member 14 is placed onto the first member 12, portions of the tabs 34 extend through the slots 42 of the second member. Referring back to FIG. 1, the tabs 34 are then deformed or bent outward to lock or latch the second member 14 with the first member 12. In alternate embodiments, any suitable type of locking or latching system between the first and second members could be provided.

Figure 6:
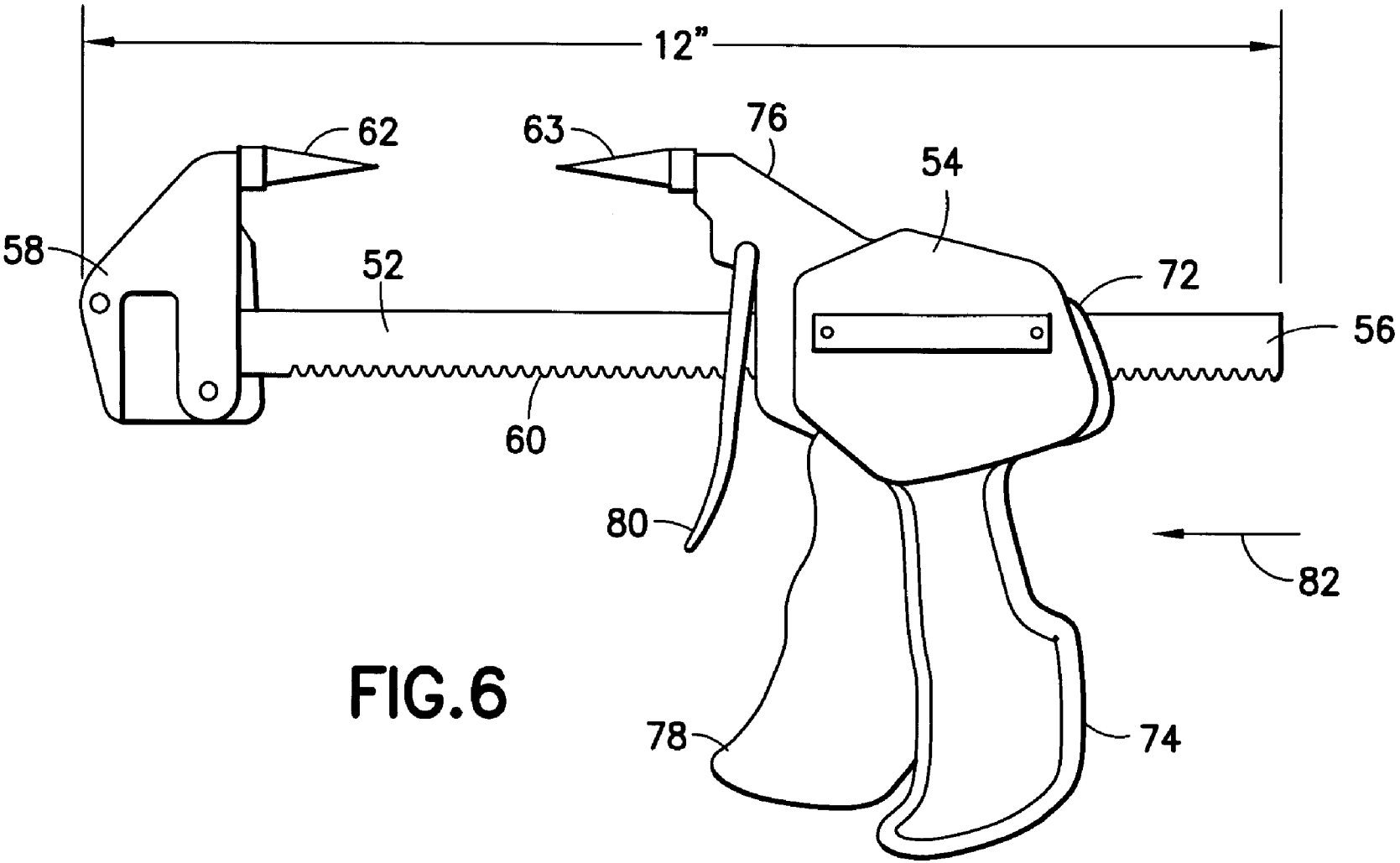
FIG. 6 is an elevational side view of an installation tool used to connect the electrical connector shown in FIG. 1 to two electrical conductors.
Figure 7:
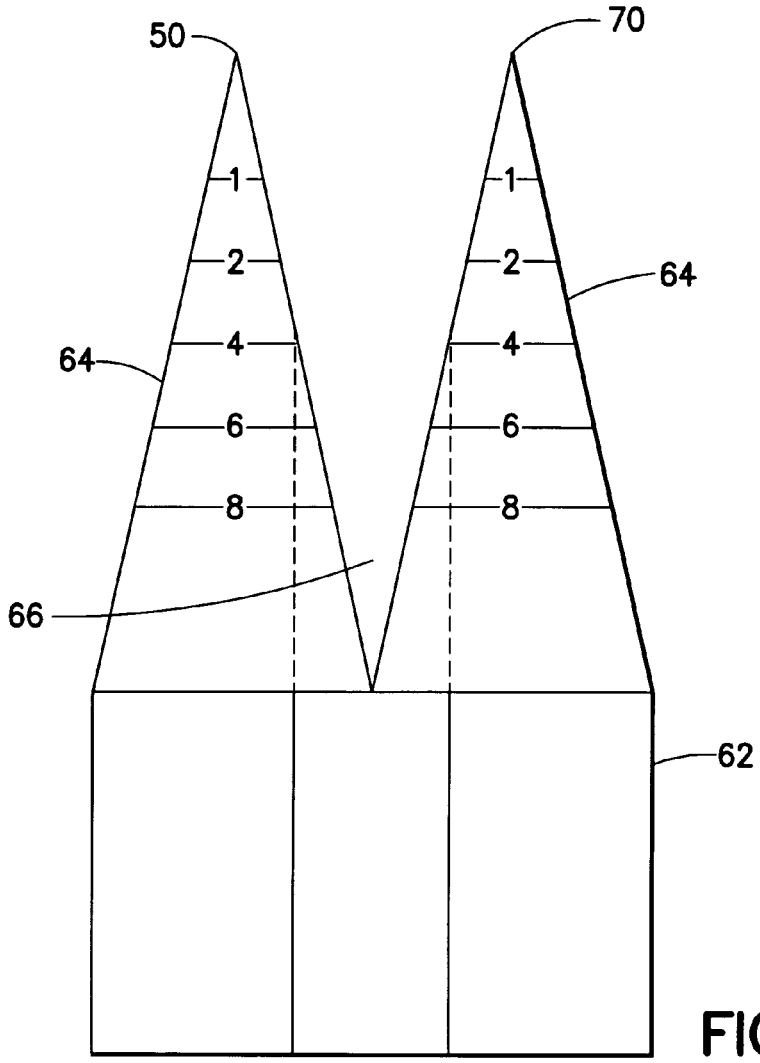
FIG. 7 is a top view of a connector wedge of the installation tool shown in FIG. 6.
Figure 8:
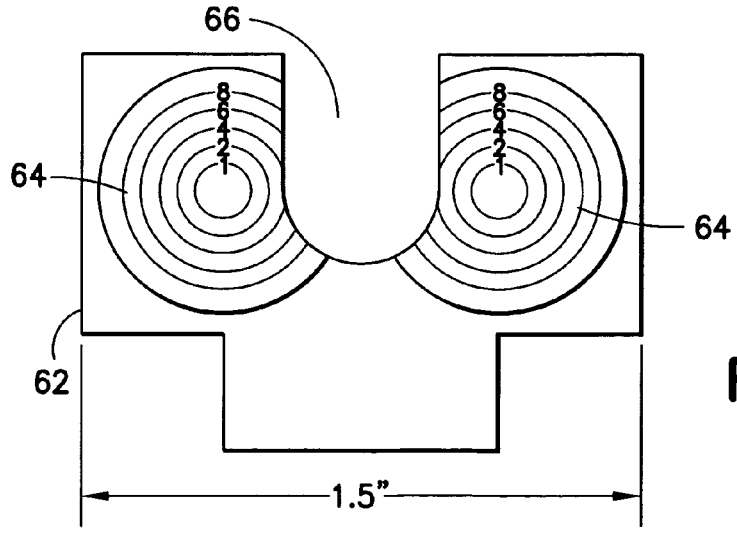
FIG. 8 is a front view of the connector wedge shown in FIG. 7.

Referring now to FIGS. 6–8, there is shown an installation tool 50 for use in attaching the electrical connector 10 to electrical conductors. In alternate embodiments, other suitable types of tools could be used to connect the electrical connector to the electrical conductors. The installation tool 50 generally comprises a stationary section 52 and a movable section 54. The stationary section 52 generally comprises a guide and latching rod 56 and an end section 58. The rod 56 comprises ratchet teeth 60 along its length. The end section 58 comprises a connector wedge 62. As seen best in FIGS. 7 and 8, the connector wedge 62 generally comprises two wedge shaped projections 64 in the form of two conically-shaped wedges or cones. The wedge shaped projections 64 extend in a same direction and comprise general cone shapes. However, in alternate embodiments, the projections 64 could comprise any suitable type of wedge shape. A conductor guiding channel 66 is located between the two wedge shaped projections 64. The projections 64 are sized and shaped, and position relative to each other, to allow the front ends 70 of the projections to be inserted into the tube sections 16, 18 of either the first connection section 22 or the second connection section 24 of the electrical connector 10.

Each projection 64 comprises indicia 68. The indicia comprises and lines associated with the numbers. In this embodiment, the numbers generally correspond to sizes of conductors, such as conductor sizes ranging from #8 to 1/0. However, in alternate embodiments, any suitable type of indicia could be provided. The projections 64 are graduated and marked with lines to indicate insertion depths required for conductor sizes. The conductor guide channel 66 is provided between the two projections to guide a conductor to a correct installation position inside the conductor receiving area 28 of the electrical connector 10.

Referring back to FIG. 6, the movable section 54 generally comprises a ratchet section 72, a handle 74, and a forward extension section 76. The ratchet section 72 is movably mounted on the rod 56. The ratchet section 72 comprises a hand lever 78 and a release lever 80. The hand lever 78 is adapted to be compressed towards the handle 74 by a hand of the user to move a ratchet against the ratchet teeth 60 of the rod 56. This moves the movable section 54 towards the end section 58 as indicated by arrow 82. The forward extension section 76 comprises a connector wedge 63 which is identical to the connector wedge 62 on the end section 58. The connector wedge 63 is located directly opposite to the connector wedge 62. Thus, when the ratchet in the ratchet section 72 is actuated by a user, the connector wedge 63 can be moved towards the connector wedge 62. A user can actuate the release lever 80 to slide the movable section 54 in a direction reverse to direction 82. Otherwise, the engagement between the ratchet and teeth on the rod prevent the movable section from moving in a direction reversed to direction 82. In alternate embodiments, any suitable type of latching transmission could be used, and any suitable type of drive mechanism could be used.

Figure 9:
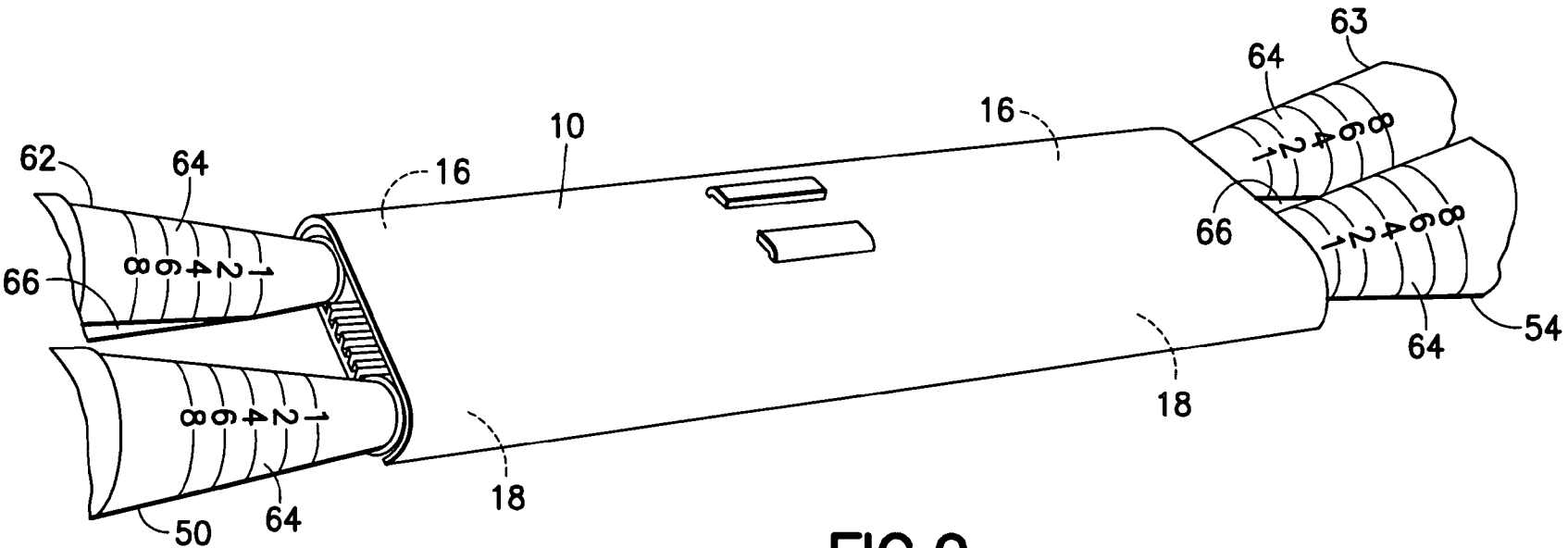
FIG. 9 is a perspective view showing the connector wedges of the tool shown in FIG. 6 being initially inserted into the electrical connector shown in FIG. 1.
Figure 10:
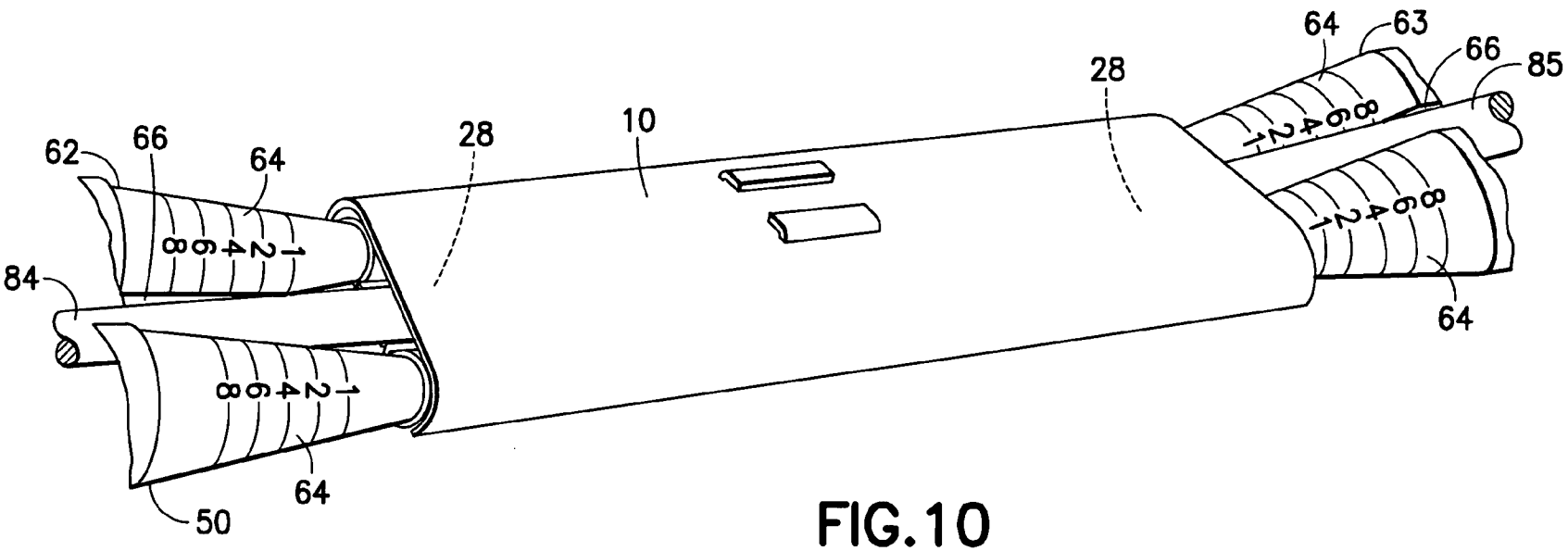
FIG. 10 is a perspective view of the tool and electrical connector shown in FIG. 9 with two electrical conductors positioned into the electrical connector.
Figure 11:
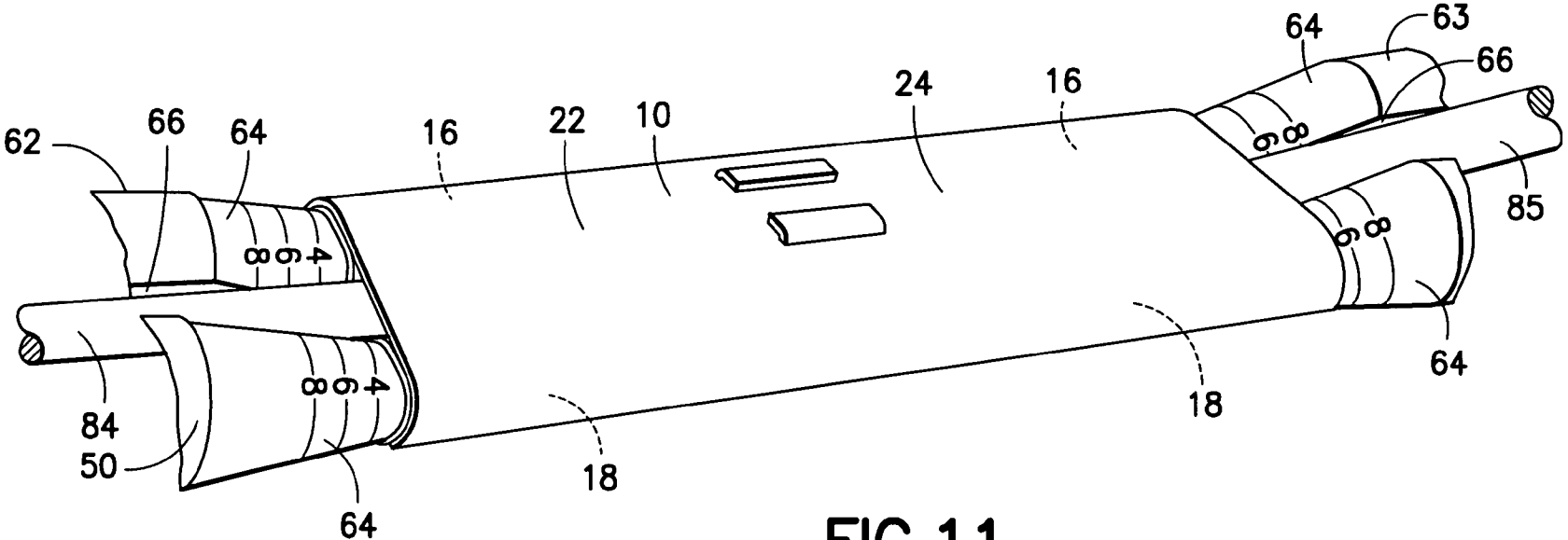
FIG. 11 is a perspective view of the tool, electrical connector, and electrical conductors shown in FIG. 10 and showing the tool moved to a tube expansion position.
Figure 12:
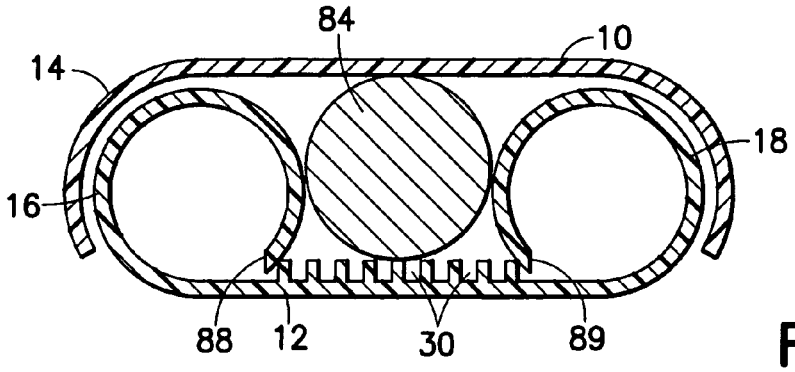
FIG. 12 is a cross sectional view of the electrical connector shown in FIG. 1 shown attached to a first electrical conductor having a first size.
Figure 13:
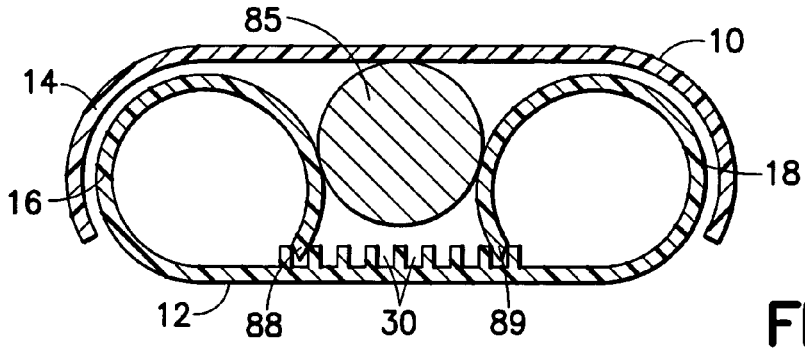
FIG. 13 is a cross sectional view of the electrical connector shown in FIG. 1 shown attached to a second electrical conductor having a second size.
Figure 14:
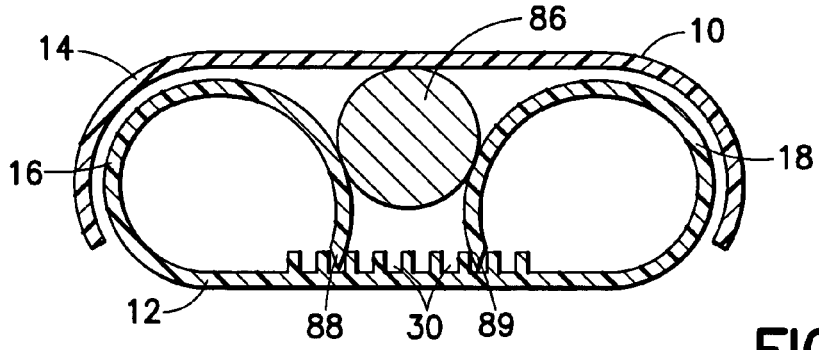
FIG. 14 is a cross sectional view of the electrical connector shown in FIG. 1 shown attached to a third electrical conductor having a third size.
Figure 15:
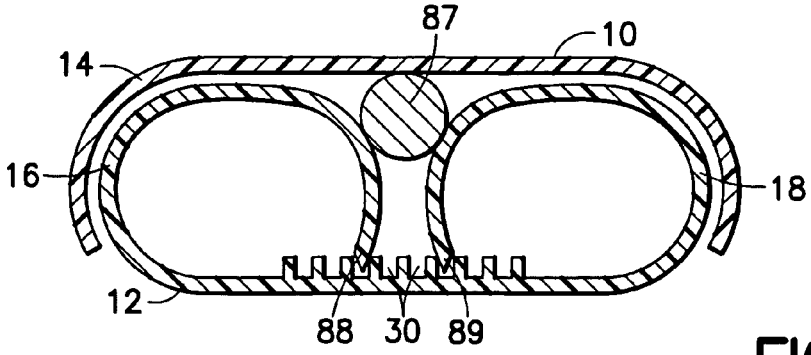
FIG. 15 is a cross sectional view of the electrical connector shown in FIG. 1 shown attached to a fourth electrical conductor having a fourth size.

Referring now also to FIGS. 9–11, the procedure for using the installation tool 50 to connect electrical conductors to the electrical connector 10 will be described. As seen in FIG. 9, the movable section 54 of the installation tool is moved to move the connector wedge 63 towards the connector wedge 62 with the electrical connector 10 therebetween. The front ends of the four wedge shaped projections, or conically-shaped wedges or cones, 64 enter into the four tube sections 16, 18. The electrical connector 10 is positioned in the tool by advancing the ramp or ratchet section 72 until the columns of the projections are inserted into the ends of all four tube section.

As seen in FIG. 10, two electrical conductors 84, 85 can be positioned in the conductor guide channel 66 of the two connector wedges 62, 63. The electrical conductors 84, 85 are inserted between the cones and into the connector 10. More specifically, an end of each of the electrical conductors 84, 85 are inserted into the open end of respective ones of the conductor receiving areas 28.

As seen in FIG. 11, the ramp or ratchet section 72 can then be moved to advance the connector wedge 63 towards the connector wedge 62. As the connector wedges 62, 63 are moved closer towards each other, the wedge shaped projections 64 extends deeper into the tube sections 16, 18. The tube sections 16, 18 in each connection section 22, 24 are deformed or expand towards each other by the wedging action of the wedge shaped projections 64 extending into the tube sections 16, 18. Each pair of tube sections 16, 18 in the connection sections 22, 24 are able to expand to clamp the respective electrical conductors 84, 85 therebetween. The tube sections 16, 18 are, thus, able to expand to the proper size for the conductor inserted. It should be noted the two conductors need not be of a same diameter because each pair of connector tube sections (16 & 18) are independently capable of adjusting to differing degrees of expansion. In this way, the connector can also serve as a reducing or adaptive splice between varying conductor sizes, such as within an allowable #8-1/0 range for example.

Referring also to FIGS. 12–15, cross sectional views of the electrical connector 10 attached to different size electrical conductors 84, 85, 86, 87 is shown. As can be seen, the electrical connector 10 is adapted to connect to a variety of sizes of electrical conductors. The tube sections 16, 18 can expand inwardly to clamp the electrical conductor between the tube sections and an inside surface of the second member 14. The free ends 88, 89 of the tube sections 16, 18 are adapted to project into the grooves 30 to stationarily retain the tube sections 16, 18 at their extended or expanded positions as shown. The grooves 30, thus, function with the free ends 88, 89 as a lock for locking the tube sections into the expanded sizes needed to retain the conductor with the connector.

Figure 16:
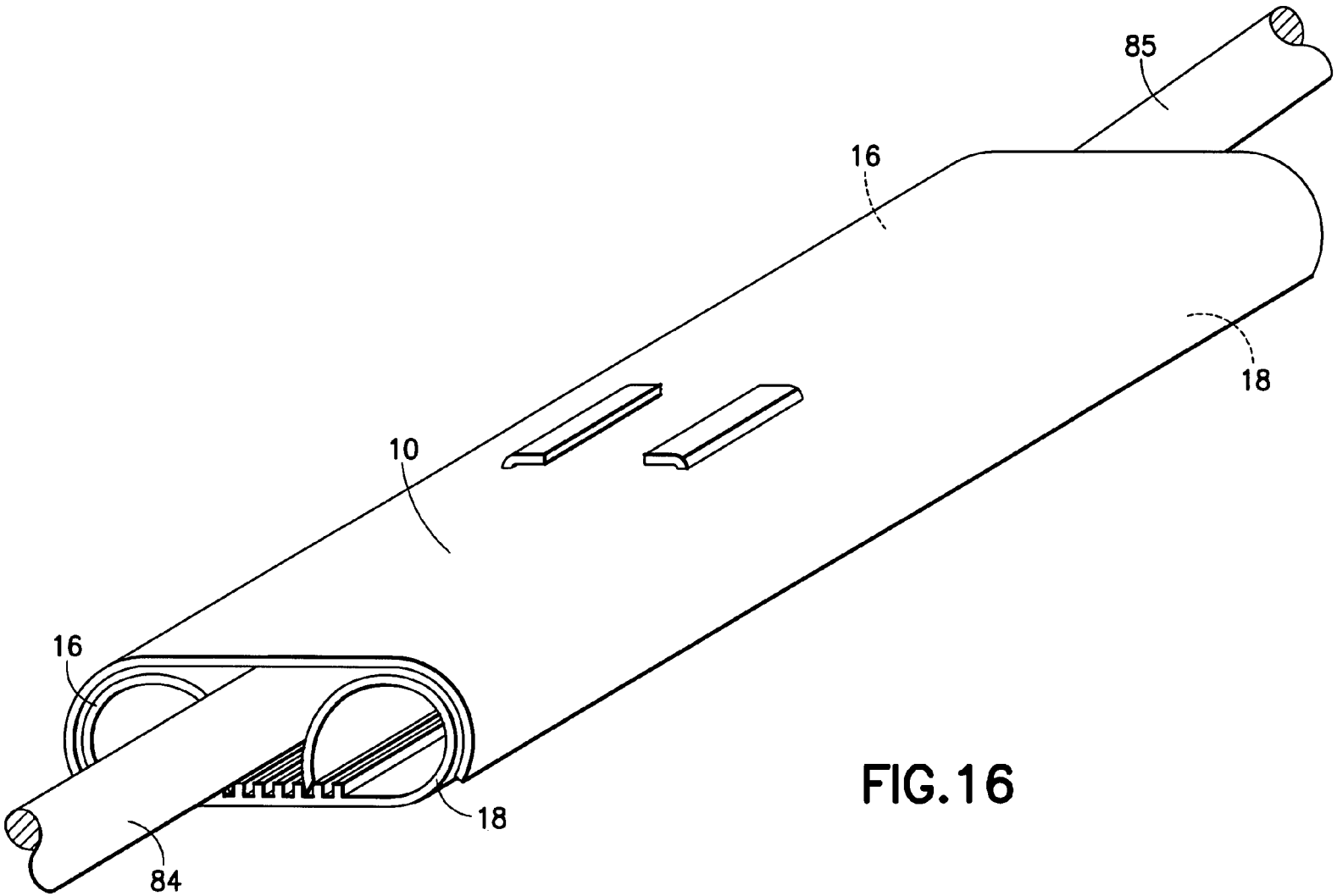
FIG. 16 is a perspective view of the electrical connector shown in FIG. 1 attached to two electrical conductors.
Figure 17:
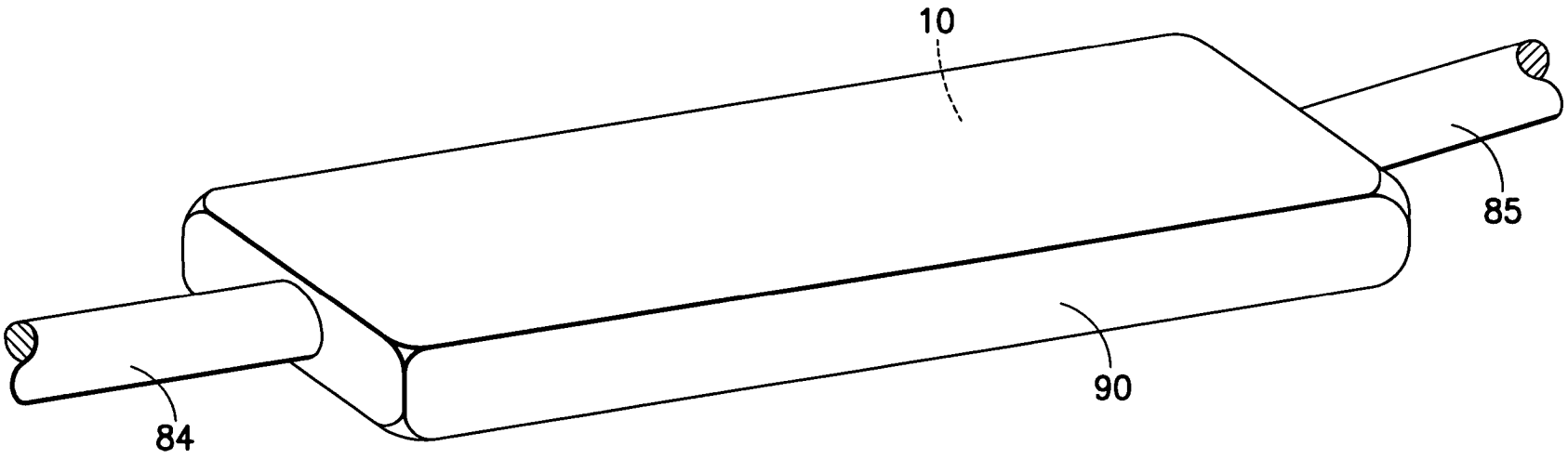
FIG. 17 is a perspective view of the electrical connector and conductors shown in FIG. 16 with a cover attached to the electrical connector.

Referring now also to FIG. 16, after the tube sections 16, 18 have been expanded to their proper size, the insertion tool can be removed by depressing the ramp retraction lever 80. The electrical conductors 84, 85 are now fixedly connected to the electrical conductor 10. Referring also to FIG. 17, a cover 90 can be attached to the electrical connector 10. For example, the covered 90 can comprise a protective ultraviolet (UV) resistant plastic cover which can be snapped into place for added security. Before insertion of the electrical conductors 84, 85 into the electrical connector 10, the conductors 84, 85 could comprise an outer layer of electrical insulation which is removed. The portions of the electrical conductors 84, 85 extending out of the cover 90 could comprise the electrical insulation. However, the electrical conductors inside the electrical connector 10 would have the electrical insulation removed to allow for a mechanical and electrical connection with the electrical connector 10 inside the conductor receiving areas 28.

Figure 18:
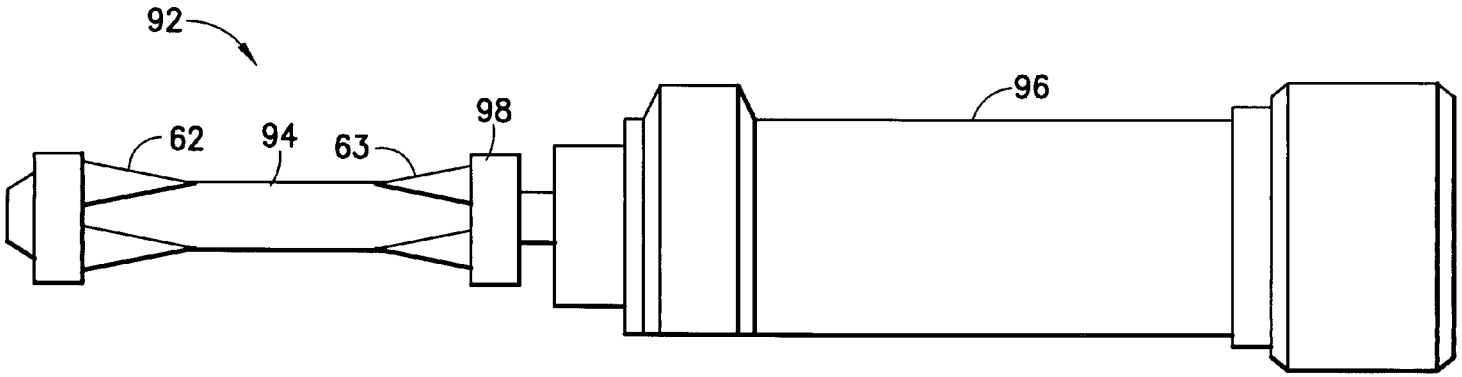
FIG. 18 is a top plan view of an alternate embodiment of the installation tool.
Figure 19:
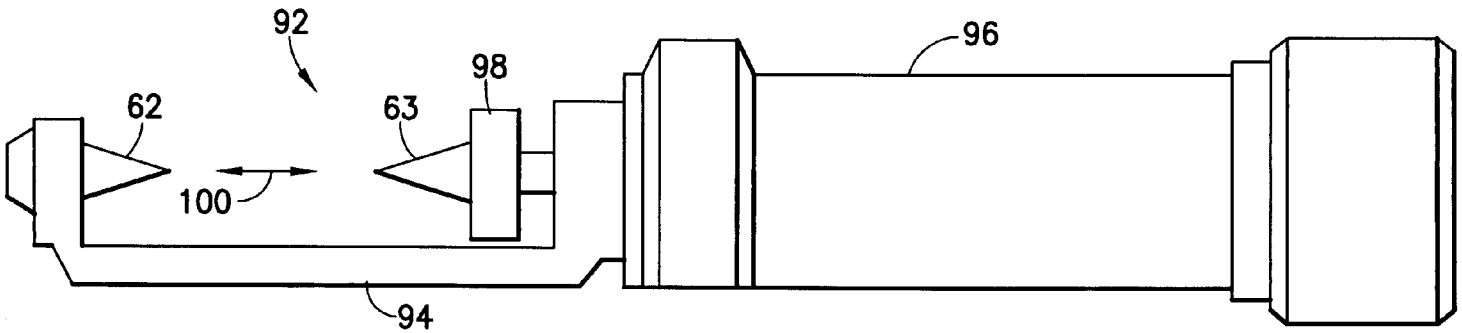
FIG. 19 is an elevational side view of the installation tool shown in FIG. 18.

Referring also to FIGS. 18–19, an alternate embodiment of the installation tool is shown. In this embodiment the installation tool 92 generally comprises a frame 94, a drive section 96, and a movable ram 98. The tool 92 comprises a first connector wedge 62 stationarily attached to the frame 94 and the second connector wedge 63 connected to the movable ram 98. The drive section 96 preferably comprises a hydraulic drive system, such as a battery operated hydraulic drive system having a battery operated pump. The ram 98 extends into the hydraulic drive system and is adapted to be moved by the hydraulic drive system towards and away from the first connector wedge 62 as indicated by arrow 100. Because the second connector wedge 63 is connected to the movable ram 98, the second connector wedge 63 can be moved towards and then away from the first connector wedge 62 by the hydraulic drive system. In the embodiment shown, the entire tool 92 can be as short as 12 in. in length. This relatively small, battery powered hydraulic tool could be used to minimize strain on a user's hand rather than using the manual installation tool shown in FIG. 6.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

two first tube sections which are open at a first end of the connector; and a first connecting section connecting the two first tube sections to each other, wherein the first tube sections and the first connecting section form a first conductor receiving area which is open at the first end of the connector, wherein the first tube sections are adapted to be expanded towards each other to capture a first conductor between the two first tube sections, wherein at least one of the first tube sections comprises a side free end adapted to move to expand the tube section, and wherein the first connecting section comprises at least one latch for latching with the side free end of the first tube section at a predetermined expanded position.

2. An electrical connector as in claim 1 further comprising two second tube section which are open at a second end of the connector and a second connecting section connecting the two second tube sections to each other.

3. An electrical connector as in claim 1 wherein the two first tube sections are generally parallel with each other.

4. An electrical connector as in claim 1 wherein the at least one latch comprises grooves on the connecting section.

5. An electrical connector as in claim 1 further comprising an outer member extending at least partially around the two first tube sections, wherein a portion of the outer member forms a side of the conductor receiving area.

6. An electrical connector as in claim 5 wherein the outer member extends along outer lateral sides of the two first tube sections to strengthen the outer lateral sides of the two first tube sections from deflecting outwardly.

7. An electrical connector as in claim 5 wherein the outer member is connected to the connecting section.

8. An electrical connector as in claim 7 wherein the connecting section comprises tabs which extend through holes in the outer member and retain the outer member with the connecting section.

9. An electrical connector as in claim 1 further comprising an outer member connected to the connecting section and forming a side of the conductor receiving area.

10. An electrical connector comprising:

a first member comprising two first tube sections and a first connecting section connecting the two first tube sections to each other, wherein the two first tube section are open at a first end of the connector; and an outer member extending at least partially around the two first tube sections, wherein the first tube sections, the first connecting section, and the outer member form a first conductor receiving area which is open at the first end of the connector, wherein the first tube sections are adapted to be expanded towards each other to capture a first conductor against the two first tube sections and the outer member.

11. An electrical connector as in claim 10 wherein at least one of the first tube sections comprises a side free end adapted to move to expand the tube section, and wherein the first connecting section comprises at least one latch for latching with the side free end of the first tube section at a predetermined expanded position.

12. An electrical connector as in claim 11 wherein the at least one latch comprises grooves on an interior facing side of the connecting section.

13. An electrical connector as in claim 10 further comprising two second tube section which are open at a second end of the connector and a second connecting section connecting the two second tube sections to each other.

14. An electrical connector as in claim 13 wherein the first and second tube sections are generally parallel with each other.

15. An electrical connector comprising:

two first tube sections which are open at a first end of the connector;

a first connecting section connecting the two first tube sections to each other; and an outer member directly connected to the connecting section and forming a side of the conductor receiving area, wherein the first tube sections and the outer member form a first conductor receiving area which is open at the first end of the connector, and wherein the first tube sections are adapted to be expanded towards each other to capture a first conductor directly against the two first tube sections and the outer member.

16. An electrical connector as in claim 15 wherein at least one of the first tube sections comprises a side free end adapted to move to expand the tube section, and wherein the first connecting section comprises at least one latch for latching with the side free end of the first tube section at a predetermined expanded position.

17. An electrical connector as in claim 16 wherein the at least one latch comprises grooves on an interior facing side of the connecting section.

18. An electrical connector as in claim 15 further comprising two second tube section which are open at a second end of the connector and a second connecting section connecting the two second tube sections to each other.

* * * * *